United States Patent [19]

Würtz

[11] Patent Number: 5,064,333

[45] Date of Patent: Nov. 12, 1991

[54] APPARATUS FOR EMPTYING CONTAINERS, PARTICULARLY REFUSE CONTAINERS

[75] Inventor: Renate Würtz, Erligheim, Fed. Rep. of Germany

[73] Assignee: Otto Lift-Systeme GmbH, Cologne, Fed. Rep. of Germany

[21] Appl. No.: 477,992

[22] PCT Filed: Oct. 15, 1988

[86] PCT No.: PCT/DE88/00633

§ 371 Date: May 8, 1990

§ 102(e) Date: May 8, 1990

[87] PCT Pub. No.: WO89/03794

PCT Pub. Date: May 5, 1989

[30] Foreign Application Priority Data

Oct. 20, 1987 [DE] Fed. Rep. of Germany ..... 3735420

[51] Int. Cl.[5] ..... B65F 3/04

[52] U.S. Cl. ..... 414/408; 414/21; 414/409; 414/421

[58] Field of Search ..... 414/406, 407, 408, 409, 414/421, 420, 419, 422, 423, 424, 21

[56] References Cited

U.S. PATENT DOCUMENTS 4,057,156 11/1977 Thompson et al. ..... 414/408
4,722,656 2/1988 Naab ..... 414/421 X
4,722,658 2/1988 Würtz et al. ..... 414/406 X
4,771,837 9/1988 Appleton et al. ..... 414/406

FOREIGN PATENT DOCUMENTS 302902 11/1972 Austria .
2721059 11/1978 Fed. Rep. of Germany .
3238810 4/1984 Fed. Rep. of Germany ..... 414/408
3517491 11/1986 Fed. Rep. of Germany ..... 414/408
3614328 10/1987 Fed. Rep. of Germany ..... 414/406

*Primary Examiner*—Frank E. Werner
*Attorney, Agent, or Firm*—Collard, Roe & Galgano

[57] ABSTRACT

In an apparatus for emptying containers, particularly refuse containers, the lifting and tipping frame (111) present the container (106) to be emptied is actuated by means of a pressure medium power circuit. This apparatus possesses, inter alia, an electrical control device (70) to activate the pressure medium power circuit, an actuating device (72) for activating the electrical control device (70), and also a switch device (92, 94) for affecting the lifting and tipping motion of the lifting and tipping frame (111), wherein the switch device is actuated by the container (106) received on the lifting and tipping frame. This apparatus is distinguished in that the switch device (92, 94) is operative for the further lifting and tipping motion only after initiation of the lifting and tipping motion, and the actuating device is a switch element (72) to be operated independently of the switch device.

14 Claims, 3 Drawing Sheets

APPARATUS FOR EMPTYING CONTAINERS, PARTICULARLY REFUSE CONTAINERS

1. FIELD OF THE INVENTION

The invention relates to an apparatus for emptying containers, particularly refuse containers, with at least one lifting and tipping apparatus which is provided with a lifting and tipping frame to receive the container to be emptied, with a pressure medium power circuit to actuate the lifting and tipping frame, with an electrical control device to active the pressure medium power circuit, with an actuating device for activating the electrical control device, and with a switch device for affecting the lifting and tipping motion of the lifting and tipping frame, wherein the switch device can be actuated by the container received on the lifting and tipping frame and is operative on the further lifting and tipping motion in such a way that the lifting and tipping motion is contained only i a container on the lifting and tipping frame is in predeterminable alignment.

2. BRIEF DESCRIPTION OF THE PRIOR ART

An apparatus of this kind is known from DE-A 3 517 491. This apparatus has a switching ledge, which can be pressed down by a container seated on the lifting and tipping apparatus and can thereby actuate a limit switch. After a certain lifting time, or after overcoming a certain lifting height, the switch initiates an automatically proceeding lifting and tipping process for a refuse container to be emptied. The limit switch is, in this case, only activated if the switching ledge is pressed down by the container edge. The switching ledge is moveable about an axis which is aligned parallel to the container edge seated on the lifting and tipping apparatus. The ledge is, thus, always pressed down, and, thus, the limit switch actuated, whenever any part of this container edge rests on the ledge from above. This entails the risk that even with "incorrect" seating of the container, as, for example, in the case of a laterally offcenter seating or partially damaged bead edge, or with the presence of dirt particles in the bead edge, a "correct" seating is simulated.

Furthermore, an apparatus is known (WO 85/13689), which is provided with an electrical control circuit which contains a switch actuated by a container placed on the lifting and tipping apparatus to switch on the control process, and a time switch determining the timed valve control for the course of the motion. The lifting and tipping apparatus is, thus, automatically started by the container placed on the lifting and tipping apparatus. As long as the refuse container is not correctly present on the lifting and tipping apparatus by the switch starting the lifting and tripping apparatus, the apparatus cannot be set in motion. The electrical control circuit provided for timed valve control can be further developed in this known apparatus, such that upon release of the container set on the lifting and tipping apparatus by the switch starting the lifting and tipping apparatus, the lifting and tipping apparatus is reset to its initial position. It is thereby ensured that the lifting and tipping motion is not continued if the container has lost its contact seating on the switch. The switch also serves the purpose in this development of automatically setting the emptying process in motion. The emptying process is, of course, interrupted as soon as the refuse container no longer abuts the switch. The probability of a correctly placed container losing its seating during the emptying process is quite small and is, for example, only imaginable in the case where load-bearing constructional elements break. If something of the kind should happen, this known emergency circuit which interrupts the lifting and tipping process would, of course, be of little help. The container would fall back uncontrollably, independently of the return travel of the lifting and tipping frame, in such an accident.

In the known apparatus, the emptying process can only be started, in any case, when the container has assumed its prescribed seating on the lifting and tipping apparatus, since only in this position can it contact the switch present on the lifting and tipping apparatus.

Now the local conditions during the emptying of refuse containers are not always such that the surface on which the refuse container stands lies in the same plane as the surface on which the wheels of the refuse truck stand during an emptying process. Transverse and longitudinal inclinations of the surface of the street have the result that the container is usually skew to the rear wall of the refuse truck. This is also the reason why, with the known apparatus, the refuse container has to be set on the lifting and tipping apparatus, since when it is in the state in which it does not load the lifting and tipping apparatus, it is not aligned parallel to the receiving ledge of the lifting and tipping apparatus. Namely, the emptying process can only be started when the container is present, mounted on the lifting and tipping apparatus in the prescribed alignment.

The presence of a switch which is automatically actuated by a container suspended in a prescribed manner on the lifting and tipping apparatus is, incidentally, known from German Offenlegungsschrift 2,721,059. The switch there acts to control the correct seating of the refuse container in that the switch is switched on by the container and causes a control light to light up. If the control light does not light up, the container is not correctly seated on the lifting and tipping apparatus. An operator initiating and monitoring the refuse process is able to interrupt continuation of the lifting and tipping process by actuating corresponding actuating elements.

SUMMARY OF THE INVENTION

Based on this prior art, the object of the invention is to provide an automatic, safe apparatus for emptying containers, particularly refuse containers, which can be used not only on flat ground surfaces, but also on ground surfaces which are arbitrarily inclined. This presupposes that the dangers existing in the above prior art are eliminated with certainty.

The solution to the prior art problem is provided according to the invention. The apparatus according to the invention for emptying containers, particularly refuse containers of the kind mentioned above, is correspondingly distinguished in that an automatically proceeding lifting and tipping process is initiated by the actuating device, in that the switch device contains two contact elements, in that both contact elements are present on the lifting and tipping apparatus such that they are movable in the plane of the lifting and tipping motion synchronously with the lifting and tipping motion, in that the first of the two contact elements is firmly attached to the lifting and tipping apparatus, and the second of the two contact elements is firmly attached to a weigh beam which is pivotable about a shaft lying in the plane of the lifting and tipping motion, in that the pivoting position of the weigh beam, and hence, the pivoting alignment of the second contact element, can be effected by contact with the container, such that when the container is in the prescribed position on the lifting and tipping frame, both of the contact elements are located in opposed contact position, so that the switch device can act on the further lifting and tipping motion such that, after a predetermined lifting and tipping motion path of the lifting and tipping frame has been traveled, a further motion of the frame occurs only when the two contact elements are located in the contact position.

In order to produce the contact, the container does not need to be positioned completely on the weigh beam, but only partially so. In this connection, it has been found to be favorable if the weigh beam is positioned such that the container can be positioned with its upper bead edge which faces the lifting and tipping frame positioned on the weigh beam.

In order to make possible a secure contact between the container and the weigh beam and to exclude production tolerances, both as regards the container and as regards the lifting and tipping apparatus, the pivot axis of the weigh beam, or the weigh beam as a whole, is mounted flexibly in the direction of the lifting and tipping motion.

According to a further feature of the invention, the switch device has a switch which can be actuated by the lifting and tipping frame after a predetermined lifting and tipping motion of the frame, wherein the switch is connected by means of the switch device to the pressure medium power circuit of the lifting and tipping apparatus and the shutoff valve contained in it such that after its actuation, the shutoff valve is kept released only when the two contact elements are in the contact position. Verification of the correct seating of the refuse container on the lifting and tipping apparatus, thus, takes place at the time when said switch is actuated. This switch, which is switched over by the motion of the lifting and tipping frame, can thus be present such that it is switched over after a predetermined lifting and tipping motion of the lifting and tipping frame, and the verification process is, thus, made possible.

An automatically operating apparatus for emptying containers, particularly refuse containers, of the kind mentioned at the beginning, does not necessarily have to be equipped with the device described above for verifying the correct seating of the refuse container on the lifting and tipping apparatus.

The verifying device is, of course, of decisive importance for operating safety. As regards the automation of the lifting and tipping process itself, and hence, of the emptying process, the apparatus mentioned at the beginning is distinguished in that a bypass duct is present for the shutoff valve, which is configured in the pressure medium power circuit as a multi-path valve, in that a second shutoff valve configured as a multi-path valve and a cylinder which is acted upon on both sides 6, 8 through this duct are present in series in the bypass duct, in that the lifting cylinder is connected to a device which counts the motion of its piston, so that this motion is reversible in its respective direction by changeover of the second shutoff valve, in that a switch element is present in the duct leading to the lifting and tipping cylinders, in that this switch element is connected to the second shutoff valve such that when a predetermined duct pressure is reached at which the lifting and tipping cylinders are in their maximum lifting and tipping position, this second shutoff valve can be changed over from its shutoff position. Also, the counting device is connected to the control device for the first shutoff valve which is short-circuited by the bypass duct such that when a predetermined number of motions of the piston is reached, the first shutoff valve can be changed over into its return flow position in which the free return flow of the pressure medium from the lifting and tipping cylinders is made possible. An automatically operating emptying apparatus constructed in this manner, thus, possesses a hydraulically operating counting device by means of which the number of shaking motions of the container in its proper emptying position can be predetermined.

It is already known, in this connection, from WO 85/03689 mentioned above, to control the shaking process by means of a time relay. The emptying process is ended by this time relay after a given time period. The number of shaking motions which are indispensable for a complete emptying of refuse containers, in the time made available by the time relay for the emptying of a refuse container depends on the speed with which the containers are moved back and forth. However, because unlike containers do not in every case move back at a constant equal speed from their maximum lifting position, the number of shaking motions is correspondingly different. This disadvantage can be avoided with the apparatus according to the invention, since the number of shaking motions, and not the time period, governs the emptying process.

In an advantageous manner, a second piston is present in the lifting cylinder, is displaceable by the first piston, and is effective outside the lifting cylinder as a contact for an electrical counter such that the counter counts further on each contact with it of the second piston.

The apparatus according to the invention is developed, according to a further feature of the invention, as a sequential circuit; this means that during the upward motion of the lifting and tipping frame, the latter is first lifted by a first cylinder unit and then tipped by a second cylinder unit In an apparatus according to the invention constructed in this manner, a branching valve is present between the first shutoff valve and the lifting and tipping cylinders, and can control the pressure medium to pass either to a first cylinder unit causing the lifting motion or to a second cylinder unit causing the pivoting motion; further, a duct is present between the first and the second cylinder unit, with a pressure limiting valve, wherein the pressure limiting valve is surrounded by a bypass duct with a check valve, and the check valve blocks the bypass duct in the direction towards the second cylinder unit. The branching valve is here advantageously changed over by the lifting and tipping apparatus itself. This ensures that the branching valve is changed over in dependence on the return part of the lifting and tipping motion.

A constructionally simple possibility of changing over the branching valve by means of the lifting and tipping apparatus is distinguished in that an actuating element is present on the lifting and tipping frame such that, after a predetermined lifting path has been travelled, the branching valve shuts off the pressure medium supply to the cylinder unit causing the lifting motion and releases it to the other cylinder unit, wherein the actuating element holds the branching valve in this position as long as the actual lifting path of the lifting and tipping frame does not fall below the predetermined lifting path.

It is desirable, because of labour protection laws, for processes which proceed automatically to be able to be halted automatically, without the intervention of the operator, when situations of possible danger arise. This means, for the automatic process of the emptying apparatus, that the operator of the apparatus or strangers must be prevented from coming into the operating region of the lifting and tipping apparatus during the emptying process, and injury to persons present there due to the motion of the lifting and tipping frame—for example during its downward motion, by contact with the lifting and tipping frame—must be prevented.

From this point of view, it has been found to be favourable to equip the automatically operating apparatus for emptying containers, particularly refuse containers, with a switch element which is constantly present in the operating region of the lifting and tipping apparatus, and to connect this switch element to the shutoff valve present in the pressure medium power circuit such that when the switch element is contacted by a stranger, the shutoff valve is displaced into its position which shuts off the duct flow of the pressure medium. Thus further operation is automatically interrupted by contact with the switch element, so that persons entering the operating region, or present there, cannot be injured by the motion of the lifting and tipping frame.

It has been found to be particularly favourable to attach the switching element to the lifting and tipping frame. The switch element is then moved together with the motion of the lifting and tipping frame, which causes no trouble; furthermore, it is ensured, in a constructionally simple manner, that the switch element is always present in the immediate neighborhood of the lifting and tipping frame which is in motion and which thus constitutes a potential danger.

In order to secure a large operating region by means of this switch element, in an advantageous manner a first switch element is present and is enlarged such that it largely covers the lifting and tipping frame laterally. As a supplement or alternative to this, a second element can be present which in turn is enlarged such that it largely covers from below the lifting and tipping frame which has been maximally pivoted upwards. An operator who has chanced to get under the pivoted-up lifting and tipping frame can thus not be injured by the lifting and tipping frame when it moves downwards, since when the lifting and tipping frame moves downwards the person comes into contact with the switch element present under the lifting and tipping frame at a time before his contact with the lifting and tipping frame. As a consequence, the lifting and tipping frame is arrested in its momentary position. The same holds for a person who comes laterally towards the lifting and tipping frame, and likewise comes into contact with the switch element which is laterally present on the lifting and tipping frame at a time before contact with the lifting and tipping frame, laterally displaces the switch element, and likewise causes the lifting and tipping frame to be arrested in its momentary position.

Further embodiments and advantages of the invention are to be gathered from the features which are further set out in the claims.

BRIEF DESCRIPTION OF THE DRAWING

The invention is described and explained in more detail below with reference to the embodiment example represented in the drawing. The features to be gathered from the description and the drawing can be used individually per se, or plurally in optional combinations, in other embodiments of the invention.

DETAILED DESCRIPTION

Figure 1:
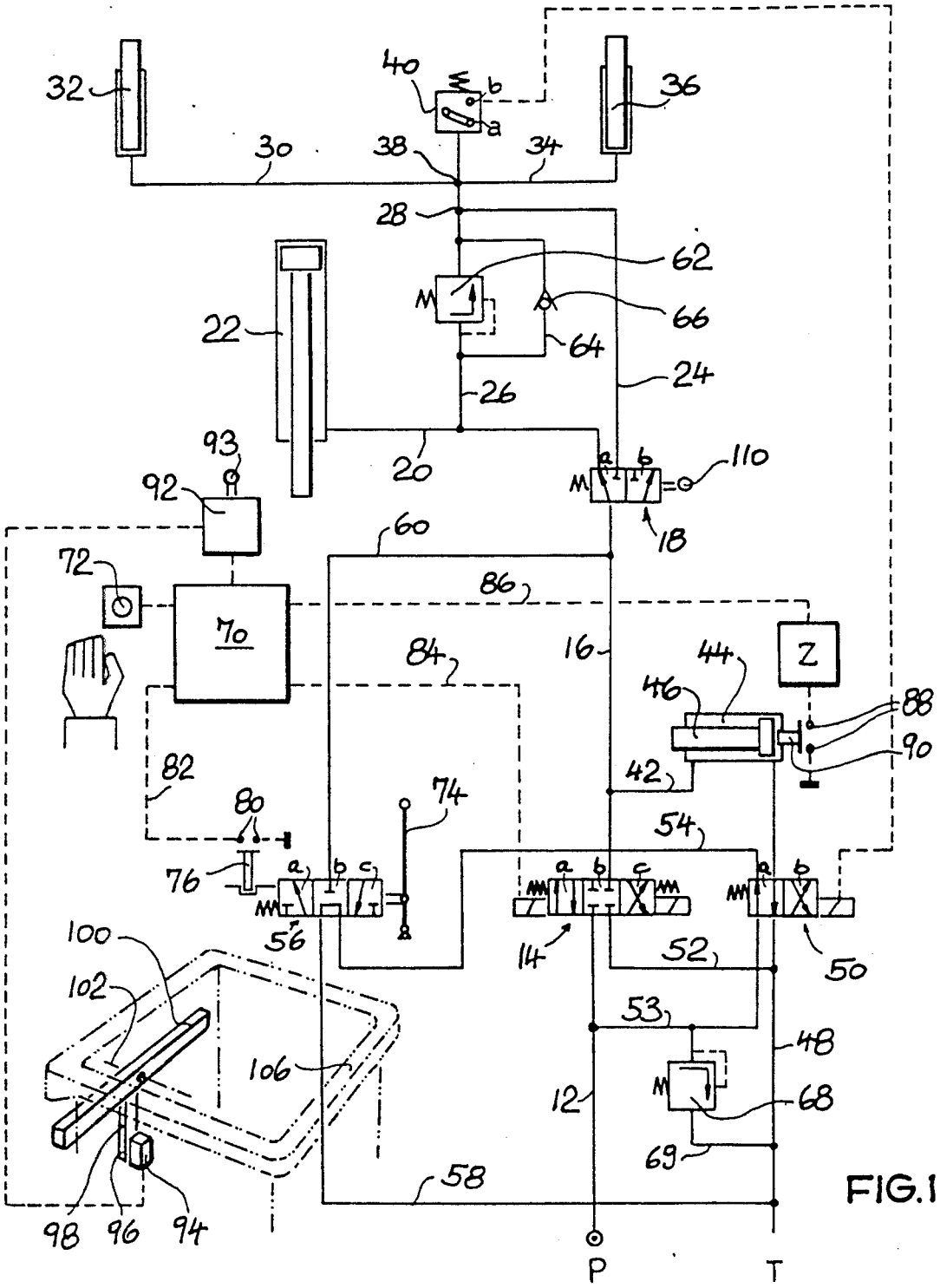
FIG. 1 shows a switching diagram for an apparatus for emptying refuse containers and equipped with a verifying device for controlling the correct seating of the refuse container.

A three-way valve 14 is acted on by a pressure medium via a duct 12 by means of a pump P from a pressure medium supply tank (not shown). A pressure medium duct 16 leads from the three-way valve 14 to a two-way valve 18. The pressure medium can be conducted from this two-way valve 18 via a further duct 20 to a lifting and tipping cylinder 22. The pressure medium is introduced by the two-way valve 18 via a further duct 24 to the point 28 in a duct 26 which branches from the duct 20. It flows further from there in the duct 26 to a branching point 38, where it opens in a left-hand duct 30 into a left-hand pivoting cylinder 32 and in a right-hand duct 34 into a right-hand pivoting cylinder 36.

A switch 40 is connected in the branching point 38 and is changed over at a given duct pressure from its position a into its position b.

A duct 42 branches from the duct 16 to a lifting cylinder 44. A piston 46 is movably mounted in this lifting cylinder 44. As long as pressure medium is introduced through the duct 42 into the lifting cylinder 44, the piston 46 is displaced—in FIG. 1—to the right. A further duct 48 leads from the right-hand end of the lifting cylinder 44 to the pressure medium supply tank T.

A two-way valve 50 is seated in this duct 48. A duct 52 between the two-way valve 50 and the tank T leads back to the three-way valve 14. The two-way valve 50 is connected via a further duct 53 to the duct 12. This duct 53 leads through the two-way valve 50 when this is in its position a and opens into a duct 54, which in turn opens into a further three-way valve 56. A return duct 58 likewise leads from this three-way valve 56 back to the pressure medium supply tank T. A further duct 60 leads from this three-way valve 56 to the duct 16.

A pressure limiting valve 62 is present in the duct 26 present in the region between the lifting cylinder 22 and the two pivoting cylinders 32, 36, and frees the duct 26 only at a predetermined duct pressure. This pressure limiting valve 62 is surrounded by a bypass duct 64, in which a check valve 66 is present. This check valve blocks the flow direction from the lifting cylinder 22 to the pivoting cylinders 32, 36.

A further pressure limiting valve 68 is present in a duct 69 which connects the duct 53 to the duct 48.

The three-way valve 14 is displaced into its different positions a, b, c by means of a control device 70. A hand switch 72 is connected to this control device 70. By actuation of this switch 72, the three-way valve 14 is switched into its position c. A blocking member 76 is present on the other three-way valve 56, which is displaced by means of an actuating lever 74 to be actuated manually, and keeps the three-way valve 56 in its blocking position b, preventing the valve 56 from being displaced by means of the actuating lever 74. Insofar as the blocking member 56 is displaced upwards—in FIG. 1—out of its blocking position, it comes into contact with two contacts 80. An electric current then flows, in the lead 82 containing the contacts 80, to the control device 70, which ensures that the three-way valve 14 cannot be moved via the electrical lead 84 out of its blocking position b, and also not by actuation of the switch 72.

A counter Z is further connected to the control device 70 via an electrical lead 86. The counter Z is in turn connected to two contacts 88. These contacts 88 can be contacted by a piston 90 which projects into the lifting cylinder 44 with its end away from the contacts 88. This piston 90 can be displaced to the right by the piston 46 of the lifting cylinder 44 and thus be placed in a position contacting the contacts 88. Each time the piston 90 abuts the contacts 88 an electrical current flows to the counter Z, increasing its count by 1. The count of this counter Z is registered in the control device 70, and when a predetermined value is reached displaces the three-way valve 14 into its position a releasing the return flow.

Figure 2:
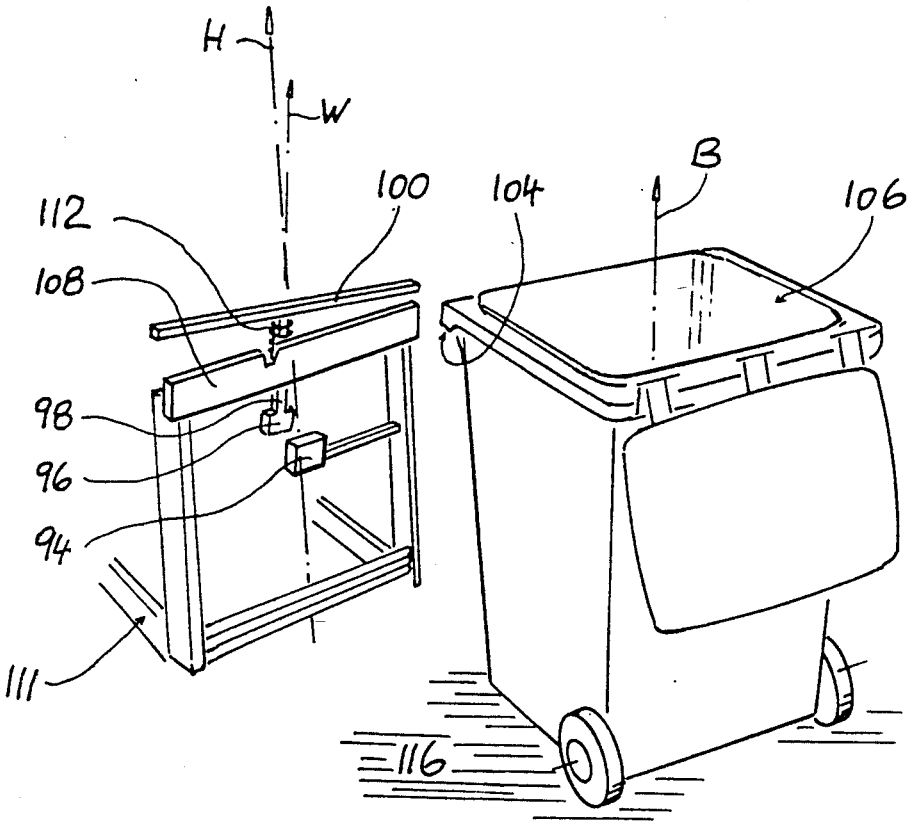
FIG. 2 shows a perspective partial view of the lifting and tipping frame equipped with elements of the verifying device and of a refuse container positioned in front of the lifting and tipping frame.
Figure 3:
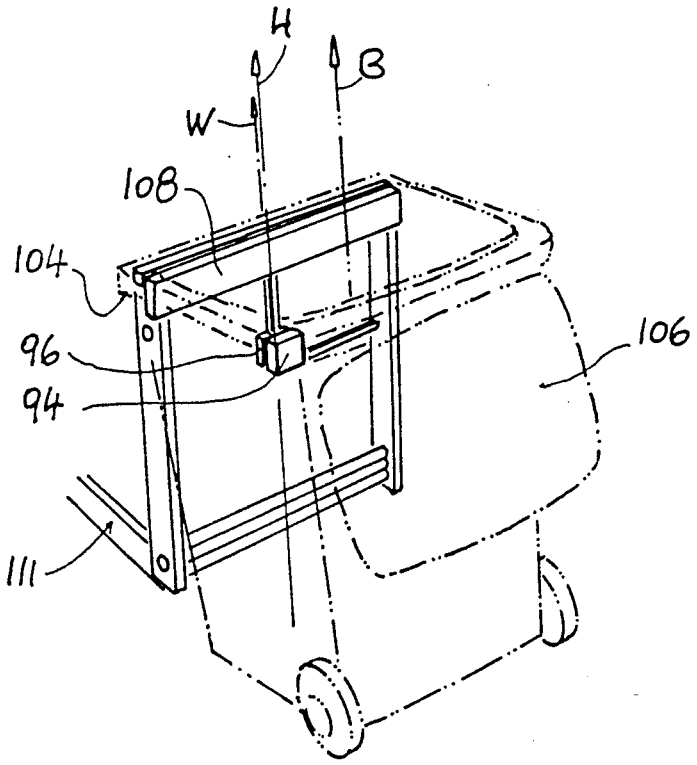
FIG. 3 shows a perspective view of the container of FIG. 2 positioned on the lifting and tipping frame.

A switch 92 is further connected to the control device 70 and is changed over by means of a lever 93. This lever 93 is brought into its two switching positions by the lifting and tipping frame of the lifting and tipping apparatus. The switch 92 is connected to a contact member 94, which is present in a fixed position on the lifting and tipping frame (FIGS. 2, 3). A further contact member 96 is adjacent to the contact member 94 and is attached to a cantilever member 98. The cantilever member 98 is attached to, and projects from, a weigh beam 100. This weigh beam 100 is mounted to pivot about a shaft 102. The bead edge 104 of a refuse container 106 abuts the weigh beam 100 from above, as will be described in more detail in FIGS. 2 and 3. At a given lift position of the lifting and tipping frame and a corresponding switching position of the lever 93, and hence a switching position of the switch 92, a control command occurs in the control device 70 on positioning of the two contacts 94, 96 in the location shown in FIG. 1, such that the three-way valve 14 remains in its position c which releases the supply of the pressure medium.

The two-way valve 18 present in the duct 16 is displaced into its two positions a or b by corresponding actuation of the lever 110. In the lowered position of the lifting and tipping frame, the two-way valve is in its position a (FIG. 1). In this position, the pressure medium flows through the ducts 16 and 20 to the lifting cylinder 22, with the result that the lifting cylinder 22 moves the lifting and tipping frame upwards. The pressure medium flows at the same time through the duct 28 to the pivoting cylinders 32, 36. The pressure medium ducts to the cylinders 22, 32, 36 are arranged such that first the lifting cylinder 22 and then the two pivoting cylinders 32, 36 are displaced. When a given pressure in the duct 30, 34 is exceeded, the switch 40 is displaced out of its position a into its position b. The switch 40 connected to the two-way valve 50 causes, in its position b, the two-way valve 50 to be displaced into its position b. In this position b, pressure medium can flow through the duct 52, through this valve 50, and further into the duct 48 to the lifting cylinder 44. The piston 46 present in the lifting cylinder 44 is displaced because of this in the leftward direction in FIG. 1. This results in a drop of pressure in the duct 30, 34, so that the pivoting cylinders 32, 36 are displaced back by a certain amount. Apart from this, the pressure drop causes the switch 40 to be reset again into its position a shown in FIG. 1, so that the two-way valve 50 is again reset into its position a shown in FIG. 1. Hence the supply through the duct 48 into the lifting cylinder 44 is interrupted again. Further supply of pressure medium through the duct 12, 16 also acts on the lifting cylinder 44 via the duct 42, so that the piston 46 is pushed to the right, against the contacts 48. At the same time the pressure rises in the ducts 30, 34, so that the pivoting cylinders 32, 36 are further displaced into their maximum upper position.

By multiple repetition of these process steps, the container 106 can be displaced in a shaking motion. The number of shaking motions is established by the counter Z. The counter Z, connected to the control device 70, causes the opened three-way valve 14 to be reset into its return flow position a after a given number of shaking motions.

When flowing back, the pressure medium first flows out of the ducts 30, 34 into the duct 24 and from there via the duct 16 through the opened three-way valve 14 back into the duct 52 and thence via the duct 69 into the tank T.

The two-way valve 18 is then in its position b, in which the duct 20 to the lifting cylinder 22 is blocked. The pressure medium can thus flow out of the lifting cylinder 22 through the pressure limiting valve 62 into the duct 24 only if the pressure in the ducts 30, 34 has fallen under the limiting value of the pressure limiting valve 62. This means that first the pivoting cylinders 32, 36, and then the lifting cylinder 22, travel back into their respective initial positions. At the moment when the lifting cylinder 22 is to be lowered, the lifting and tipping frame has been lowered far enough for it to displace the lever 110 of the two-way valve 18 and hence reset the two-way valve into its position a. Pressure medium can now also flow out of the duct 20 into the tank T.

By means of the three-way valve 56 additionally present on the lifting and tipping frame, the lifting and tipping apparatus can be conventionally actuated "by hand" by means of the actuating lever 74. The counter Z is not activated in this kind of actuation of the lifting and tipping frame and hence is not made use of.

The contacts 94, 96 present on the switch 96 operate as follows. By placing of the container 106 on the receiving ledge 108 of the lifting and tipping frame 111, the bead edge 104 of the container 106 comes into contact from above with the upper side of the weigh beam 100. The weigh beam 100 is thereby pressed downwards against the force of a spring 112 and aligned parallel to the bead edge 104. The cantilever member 98 projecting downwards away from the weigh beam 100 is correspondingly moved with it. Provided that the container 106 has assumed its predetermined location on the receiving ledge 108, the contact member 96 lies exactly adjacent to the contact member 94 which is present on the lifting and tipping frame. Provided that the switch 92 has now been correspondingly switched by actuation of the lever 93, a corresponding control current flows through the contact 94, 98, which are opposed in the contact position, to the control device 70, causing the three-way valve 14 to remain in its position c. Provided that the contacts 94, 96 do not exactly oppose each other, and in fact at the moment when the switch 92 is switched by the lever 93, the three-way valve 14 is reset into its position a by the control device 70. It is of course also possible to displace the three-way valve into its shutoff position b, in which the pressure medium does not flow back into the tank T, but remains in the ducts, so that the lifting and tipping apparatus, and hence the lifting and tipping frame, likewise remains in the lifting and tipping position which it has assumed. A decision can thus be made whether the lifting and tipping frame is to be displaced back into its initial position or whether the lifting and tipping process is to continue "by hand", e.g., by means of the three-way valve 56. The latter would be conceivable, for example, because the container 106, in spite of not being precisely positioned on the receiving ledge 108, can be safely moved further and emptied by the lifting and tipping frame 110.

The weigh beam 100 in the unloaded state is in general not aligned parallel to the receiving ledge 108. Thus the direction W normal to it, which also reproduces the direction of the stressing force of the spring 112, is not aligned in space parallel to the lifting direction H of the lifting and tipping frame 111. The lifting and tipping frame 111 is hence aligned in the same way as the refuse truck to which it is attached. Independently of this, a direction B is present with which the container 106 is aligned in the vertical direction. This direction B is normal to the plane 116 on which the refuse container 106 rests. This plane 116 is in general not the same as the plane on which the refuse truck rests with its wheels during the emptying process. Thus the direction B is in general not aligned parallel to the lifting direction H.

As soon as the container is positioned over the receiving ledge 108, the lifting and tipping frame 111 is displaced in the lifting motion by actuation of the switch 72, and the receiving ledge 108 abuts from below against the edge of the container 106 and lifts the container 106 upwards on continuation of the lifting motion. During this lifting of the container edge, and hence of the container, the bead edge 104 abuts from above on the weigh beam 100, so that the two contacts 94, 96 come into the contact position with each other. Provided that the container 106 does not rest precisely on the receiving ledge 108, the bead edge 104 can also not lie precisely on the weigh beam 100, so that the two contacts 94, 96 cannot come into the opposed contact position. The corresponding correct or incorrect position of the container on the weigh beam 100, and hence on the receiving ledge 108, is established after a given lifting path, and the three-way valve 14 is correspondingly displaced, or left in its open position c.

The apparatus according to the invention can be arranged both for simple dumpings and for multiple dumpings arranged optionally. The contact members 94, 96 can be any contact means with the precondition of making an opposed contact.

Figure 4:
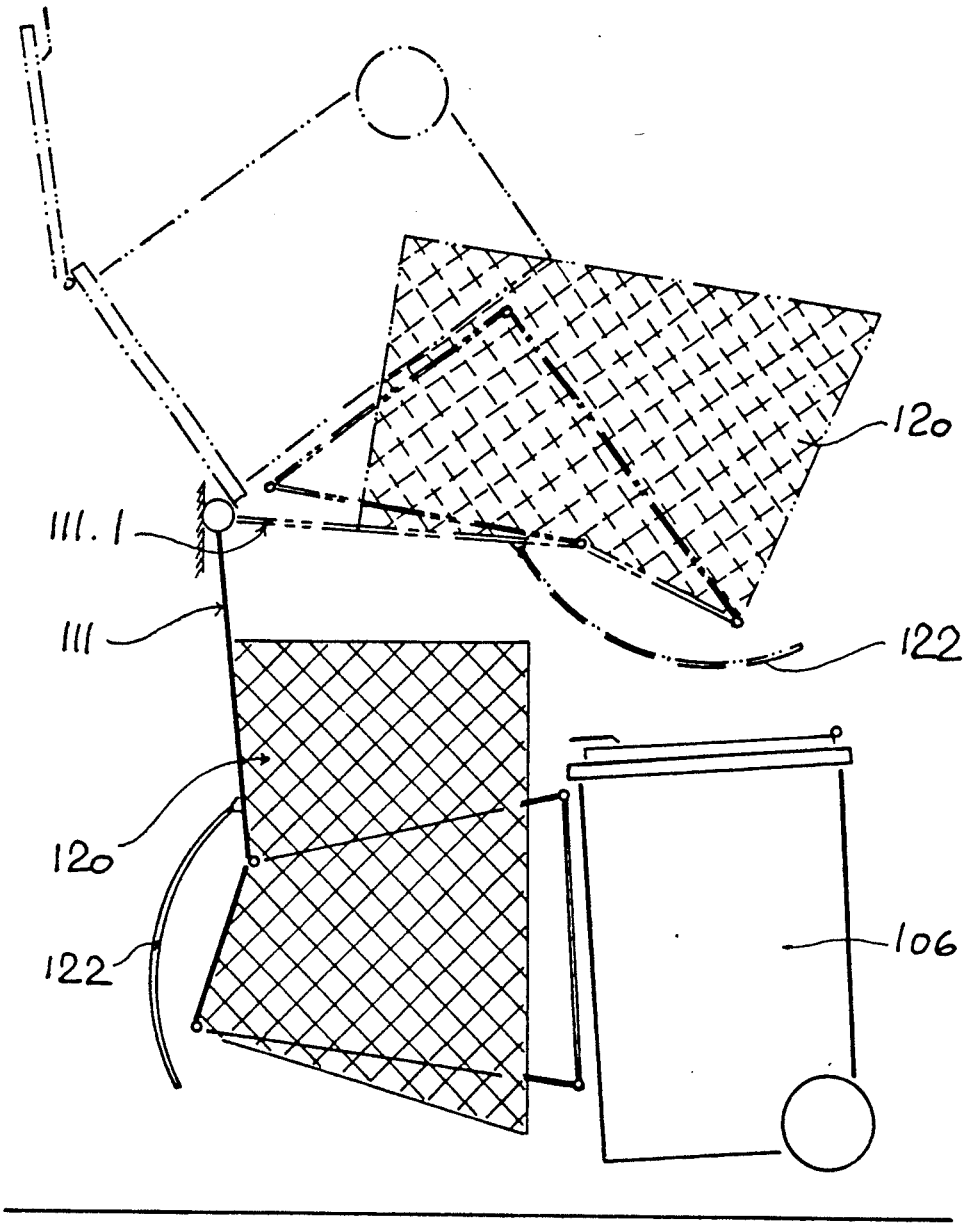
FIG. 4 shows a schematic side view of the lifting and tipping frame with a refuse container placed on it, in a lower position (full lines) and an upper position (dashed lines), and provided both laterally and also beneath it with a safety device.

The lifting and tipping frame 111 is shown in FIG. 4 with a suspended container 106 which is provided with a safety device to prevent persons being injured by contact with the moving lifting and tipping frame.

A switch element 120 is respectively attached laterally to the lifting and tipping frame 111. This switch element extends on the surface and largely covers the interspace between the refuse container 106 and the pivot arms of the lifting and tipping frame 111 which are adjacent to the refuse container. These switch elements 120 are switched by lateral contact. This switching causes the lifting and tipping frame 111 to be blocked in its lifting and tipping position at the time. This is effected by displacement of the shutoff valve 14 present in the pressure medium power circuit into its shutoff position b, by switching of the switch element 120.

While injury by the lifting and tipping frame 111 of a person who has come laterally into the pivoting region of the lifting and tipping frame 111 is thus prevented by the switch element 120, a further switch element 122, which is present on the side of the lifting and tipping frame 111 facing away from the container 106, prevents injury of a person by the downward moving lifting and tipping frame who has gotten under the raised lifting and tipping frame 111.1. For this purpose the switch element 122 acts on the shutoff valve 14 in the same manner as the switch element 120. Thus, on downward movement of the raised lifting and tipping frame 111.1, shown dashed, the switch element 122 present under the lifting and tipping frame 111.1 would first come into contact with a person present under the lifting and tipping frame. The shutoff valve 14 would be displaced into its shutoff position b by this contact, in a similar manner as occurs due to the switch element 120.

The switch element 122 is also of sheet-like form, like switch element 120. While the switch element 120 largely covers the lifting and tipping frame 111 laterally, the switch element 122 protects the raised lifting and tipping frame 111.1 from below. The shape and size of the switch elements 120, 122 are in accordance with the construction and size of the respective lifting and tipping frame 111.

I claim:

1. Apparatus for emptying a container, particularly a refuse container, comprising:

at least one lifting and tipping apparatus, which is provided with a lifting and tipping frame to receive the container to be emptied;

lifting and tipping means operatively connected to the lifting and tipping apparatus for moving the lifting and tipping apparatus to empty the container;

a pressure medium power circuit to actuate the lifting and tipping frame;

said lifting and tipping apparatus including mounting means therefor on a larger container;

an electrical control device to activate the pressure medium power circuit;

an actuating device for activating the electrical control device;

a switch device for affecting the lifting and tipping motion of the lifting and tipping frame, wherein the switch device can be actuated by the container received on the lifting and tipping frame and is operative for the further lifting and tipping motion in such a way that the lifting and tipping motion is effected only if a container on the lifting and tipping frame is in predeterminable alignment;

said actuating device initiating said motion and maintaining said motion as an automatically proceeding lifting and tipping motion;

said switch device containing two contact elements;

both of said contact elements are present on the lifting and tipping apparatus such that they are movable in the plane of the lifting and tipping motion synchronously with the lifting and tipping motion;

the first of the two contact elements is firmly attached to the lifting and tipping apparatus;

the second of the two contact elements is firmly attached to a weigh beam which is pivotable about a shaft mounted on the lifting and tipping apparatus lying in the plane of the lifting and tipping motion; and said weigh beam having a pivoting position, and said pivoting position, and hence, the pivoting alignment of the second contact element being affected by contact with the container such that when the container is in the prescribed position on the lifting and tipping frame, both of the contact elements are located in the opposed contact position, so that the switch device can act on the further lifting and tipping motion such that, after a predetermined lifting and tipping motion path of the lifting and tipping frame has been traveled, a further motion of the frame occurs only when the two contact elements are located in the contact position.

2. Apparatus according to claim 1, wherein at least parts of the container can be positioned on the weigh beam.

3. Apparatus according to claim 2, wherein the container parts include an upper bead edge and said container can be positioned on the weigh beam with its upper bead edge facing the lifting and tipping frame.

4. Apparatus according to claim 2, wherein the weigh beam has a pivot axis which is mounted flexibly in the direction of the lifting and tipping motion.

5. Apparatus according to claim 1, further comprising a switch which can be actuated by the lifting and tipping frame after a predetermined lifting and tipping motion of this frame; and said switch is connected to the switch device and a shutoff valve present in the pressure medium power circuit such that after its actuation, the shutoff valve is kept released only when the two contact elements are in the contact position.

6. Apparatus according to claim 1, further comprising a bypass duct present for a shutoff valve, which is configured in the pressure medium power circuit as a multipath valve;

a second shutoff valve configured as a multipath valve and a lifting cylinder, which is acted upon on both sides through this duct, are present in series in the bypass duct;

a lifting cylinder having a piston is connected to a device which counts the motion of the piston so that this motion is reversible in its respective direction by changeover of the second shutoff valve;

a switch element is present in the duct leading to the lifting and tipping cylinder;

said switch element being connected to the second shutoff valve such that when a predetermined duct pressure is reached at which the lifting and tipping cylinder is in the maximum lifting and tipping position, this second shutoff valve can be changed over from its shutoff position; and the counting device is connected to the control device for the first shutoff valve which is short-circuited by the bypass duct, such that when a predetermined number of motions of the piston is reached, the first shutoff valve can be changed over into its return flow position in which the free return flow of the pressure medium from the lifting and tipping cylinder is made possible.

7. Apparatus according to claim 6, wherein a second piston is present in the lifting cylinder, is displaceable by the first piston, and is effective outside the lifting cylinder as a contact for an electrical counter, such that the counter counts further on each contact it has with the second piston.

8. Apparatus according to claim 6, wherein a branching valve is present between the first shutoff valve and the lifting and tipping cylinder and can control the pressure medium to pass either to a first cylinder unit, causing the lifting motion, or to a second cylinder unit, causing the pivoting motion.

a duct is present between the first and the second cylinder unit, with a pressure limiting valve; and the pressure limiting valve is surrounded by a bypass duct with a check valve, wherein the check valve blocks the bypass duct in the direction towards the second cylinder unit.

9. Apparatus according to claim 8, wherein the branching valve can be changed over by the lifting and tipping apparatus.

10. Apparatus according to claim 9, wherein an actuating element is present on the lifting and tipping frame such that after a predetermined lifting path has been traveled, the branching valve shuts off the pressure medium supply to the cylinder unit, causing the lifting motion and releases it to the other cylinder unit, wherein the actuating element holds the branching valve in this position, as long as the actual lifting path of the lifting and tipping frame does not fall below the predetermined lifting path.

11. Apparatus according to claim 6, wherein said switch element is constantly present in the operating region of the lifting and tipping apparatus;

this switch element is connected to the shutoff valve such that when contacting of the switch element occurs, the shutoff valve can be displaced into its position which shuts off the duct flow of the pressure medium.

12. Apparatus according to claim 11, wherein the switch element is attached to the lifting and tipping frame.

13. Apparatus according to claim 11, wherein a first switch element is present and is enlarged flat, such that it largely covers the lifting and tipping frame laterally, this switch element in the transverse direction, which acts on the switch element in the transverse direction, which is in a direction normal to the lifting and tipping plane.

14. Apparatus according to claim 11, wherein a second switch element is present and is enlarged flat, such that it largely covers from below the lifting and tipping frame which has been maximally pivoted upwards, this switch element being switchable by pressure which acts on it in the lifting and tipping direction.

* * * * *